US009055851B2

(12) United States Patent
Johansson

(10) Patent No.: US 9,055,851 B2
(45) Date of Patent: Jun. 16, 2015

(54) LOCKING SYSTEM FOR A DISHWASHER

(75) Inventor: Alf Johansson, Huskvarna (SE)

(73) Assignee: Electrolux Home Products Corporation N.V., Raketstraat (BE)

( * ) Notice: Subject to any disclaimer, the term of this patent is extended or adjusted under 35 U.S.C. 154(b) by 700 days.

(21) Appl. No.: 12/664,809

(22) PCT Filed: Jun. 9, 2008

(86) PCT No.: PCT/EP2008/004569
§ 371 (c)(1),
(2), (4) Date: May 4, 2010

(87) PCT Pub. No.: WO2008/151765
PCT Pub. Date: Dec. 18, 2008

(65) Prior Publication Data

US 2010/0212693 A1 Aug. 26, 2010

(30) Foreign Application Priority Data

Jun. 15, 2007 (EP) ..... 07011742

(51) Int. Cl.
*A47L 15/42* (2006.01)
*A47L 15/00* (2006.01)

(52) U.S. Cl.
CPC ..... *A47L 15/0049* (2013.01); *A47L 15/0084* (2013.01); *A47L 15/4259* (2013.01);
(Continued)

(58) Field of Classification Search
CPC ..... A47L 15/4259; A47L 15/0049; A47L 15/0084; A47L 2401/26; A47L 2401/34; A47L 2501/05; A47L 2501/22
USPC ..... 134/57 D, 18, 200, 56 D, 56 R, 57 DL, 134/57 R, 58 D, 58 DL, 58 R
See application file for complete search history.

(56) References Cited

U.S. PATENT DOCUMENTS 3,600,602 A * 8/1971 Yartz ..... 307/141.8
5,797,409 A * 8/1998 Cooper et al. ..... 134/18
(Continued)

FOREIGN PATENT DOCUMENTS

EP 0669098 8/1995
JP 2002017642 A 1/2002
(Continued)

OTHER PUBLICATIONS

Machine translation of JP2002-306392 to Kawaguchi et al.*
(Continued)

*Primary Examiner* — Michael Kornakov
*Assistant Examiner* — Douglas Lee
(74) *Attorney, Agent, or Firm* — Banner & Witcoff, Ltd.

(57) ABSTRACT

The present invention relates to a locking system for a drawer of a drawer dishwasher and a method for unlocking a drawer of a drawer dishwasher. The locking system includes a locking device for locking a drawer of the drawer dishwasher to a chassis or frame of the dishwasher; an opening attempt sensor for detecting an opening attempt of the drawer; and a control unit connected to the opening attempt sensor and the locking device. The control unit is arranged to trigger stop of a dishwasher pump of the dishwasher based on a detected opening attempt, and wherein the control unit is further arranged to trigger the locking device to unlock after the dishwasher pump has been stopped. Thereby, there is provided a reliable and safe way of opening the drawer during a washing program without the risk of hot water splashing out onto the user or onto the floor.

16 Claims, 6 Drawing Sheets

(52) U.S. Cl.
CPC ..... *A47L2401/26* (2013.01); *A47L 2401/34* (2013.01); *A47L 2501/05* (2013.01); *A47L 2501/22* (2013.01)

(56) References Cited

U.S. PATENT DOCUMENTS

| | | | | |
|---|---|---|---|---|
| 2003/0168080 | A1 * | 9/2003 | Raches | 134/18 |
| 2007/0119485 | A1 * | 5/2007 | Gunnerson et al. | 134/58 DL |

FOREIGN PATENT DOCUMENTS

| | | | |
|---|---|---|---|
| JP | 2002191538 | | 7/2002 |
| JP | 2002306392 | | 10/2002 |
| JP | 2002306392 | A * | 10/2002 |
| JP | 2003088488 | | 3/2003 |
| JP | 2007007457 | | 1/2007 |
| KR | 19950001924 | | 3/1995 |

OTHER PUBLICATIONS

Machine translation of JP2002-306392 to Kawaguchi et al. dated Oct. 2002 (translation done May 14, 2012).*
Copy of the International Search Report, 2 sheets, dated Jul. 25, 2008.
Office Action dated Oct. 17, 2014 issued in corresponding Korean Application No. 10-2009-7027085.
Office Action dated Apr. 7, 2015 issued in corresponding Korean Application No. 10-2009-7027085.

* cited by examiner

LOCKING SYSTEM FOR A DISHWASHER

This application is a national stage application of co-pending PCT application PCT/EP2008/004569 filed Jun. 9, 2008. The disclosure of this application is expressly incorporated herein by reference in its entirety.

TECHNICAL FIELD

The present disclosure relates to drawer dishwashers. More particularly, the present disclosure relates to a locking system for a drawer of a drawer dishwasher.

BACKGROUND

A drawer dishwasher may be fully integrated in the kitchen fixtures and the front side may be covered by a panel, e.g. a wooden panel. The drawer dishwasher further has a dishwasher pump, which may be mounted at the rear part of the drawer dishwasher housing or cabinet. The dishwasher pump provides a spray nozzle with hot water, and the spray nozzle usually distributes water upwardly in a washing tub of the drawer dishwasher.

On a fully integrated drawer dishwasher, covered with e.g. a wooden panel, it is not acceptable or at least not desirable, for aesthetic reasons, to have buttons or other interfaces, such as light-emitting diodes or other lamps on the front side of the drawer, which often can be seen on conventional dishwashers.

The lack of buttons and/or other interfaces at the front of the drawer dishwasher presents the person using the drawer dishwasher with difficulties in those cases when the drawer needs to be opened when the dishwasher is turned on, since there are no possibilities to turn the dishwasher off, before opening the drawer. There is however sometimes still a need for the possibility to open the drawer of the drawer dishwasher, while the washing programme is running. The user would then have to pull the drawer open with the risk of getting hot water sprayed from the nozzle splashed onto the user, or at least the risk that hot water splashes out on the floor, since the water pressure from the spray nozzle needs to be quite high in order to properly clean the dishes. This problem is especially large for drawer dishwashers since the drawer comprising the washing tub in which the spray nozzle is arranged, is drawn out when the dishwasher is opened. Therefore, it is important to be able to open the drawer of a drawer dishwasher in a safe way when the dishwasher is turned on, i.e. without the risk of hot water splashing out on the floor or at the person opening the drawer.

EP 0,669,098 A1 discloses a dishwasher of the conventional type with a front door which does not comprise any buttons etc. This document describes a solution for enabling safe inspection and/or control and/or opening of a dishwasher based on equipping a loading door of a dishwasher with a frontal decor-panel, which is substantially hinged on the lower half of the loading door. Thus the frontal panel can be swung in its upper section and retracted from said section of the door. The solution is thus based on the interaction of the frontal panel and the door, i.e. the frontal panel is movable in relation to the door, when displacing the panel a rod arranged in the door will detect this displacement and cause a micro switch to cut the power feed to the dishwasher. Since the solution concerns a loading door of a conventional dishwasher equipped with a frontal panel, which is moveable in relation to this loading door this solution should not be applicable in a drawer dishwasher. The solution also pertains to a separate frontal panel, which is a vulnerable and less stable solution than a fixed front or door in that the connection to the mechanism or power cut off might be exposed to outside wear and fatigue.

JP 2003088488 discloses a latch operation locking/unlocking mechanism in a dishwasher, comprising a locking device with a micro switch which detects a locked/unlocked state of the latch, the switch controls the on/off mechanism of the power supply to the dishwasher pump motor, thereby preventing the water from jetting in the dishwasher, when the washing cabinet is drawn out, i.e. the latch is unlocked, during operation. This document discloses a pull-and-stop operation of the locking/unlocking system. By pull-and-stop is meant that the operation of the dishwasher, i.e. the water pump, is shut off simultaneously as the door or drawer is opened and there is hence a risk that the pump is not properly turned off before the washing cabinet is fully drawn out.

Consequently, there is a need for a locking/unlocking system for a drawer dishwasher, which provides a reliable and stable detection of the opening of the drawer of the drawer dishwasher for a safe shut off of the dishwasher pump and hence the water supply.

SUMMARY

It is a general object of the present disclosure to provide an improved or alternative locking/unlocking system for a drawer of a drawer dishwasher, which eliminates or alleviates the above mentioned disadvantages.

According to a first aspect, this object is achieved by a locking system for a drawer of a drawer dishwasher, which locking system comprises: a locking device for locking the drawer to a chassis or frame of the dishwasher; an opening attempt sensor for detecting an opening attempt of the drawer; and a control unit connected to the opening attempt sensor and the locking device. The control unit is arranged to trigger stop of a dishwasher pump of the dishwasher based on a detected opening attempt, and to trigger the locking device to unlock after the dishwasher pump has been stopped. By the locking system having this arrangement, where the drawer is unlocked and thereby openable by a user first after the dishwasher pump has been shut off, there is provided a reliable and safe way of opening the drawer without the user running the risk of having hot water splashing out onto him/her or onto the floor. Also, if the locking device would unlock simultaneously to the opening attempt, there is a risk that the locking device would be blocked, since e.g. a bolt of the locking device may be jammed in a cylinder of the locking device due to a pulling force of a user when the user tries to open the drawer. This risk would be low if the locking device is unlocked after the opening attempt has been detected and after the pump has been stopped.

According to an embodiment of the invention, the control unit is arranged to wait for a period of time after triggering stop of the dishwasher pump before triggering unlocking of the locking device. Thereby, it is further ensured that no water can be propelled into the washing tub when the user opens the drawer, further reducing the risk that water would splash onto the floor. According to a variant of this embodiment, the period of time is selected to 1-2 seconds, which is considered to be a sufficient time for the dishwasher pump to be shut off properly and also sufficient for the water to have ceased to be distributed through the nozzle, and at the same time not too long time such that the user becomes impatient when trying to open the drawer.

According to another embodiment, the control unit is arranged to wait for a signal from the dishwasher pump that the pump has been stopped before triggering the unlocking of the locking device. Thereby, it is still further ensured that no water can be propelled into the washing tub when the user opens the drawer, further reducing the risk that water would splash onto the floor.

According to another embodiment of the invention, the opening attempt sensor is arranged to detect a displacement of the drawer in relation to the chassis of the dishwasher. Thereby, a reliable detection of an opening attempt can be achieved. Also, the arrangement would be user-friendly when an opening attempt is detected as a displacement compared to e.g. detecting an opening attempt by detecting an opening force exercised by a user, because the displacement would be a confirmation to the user that he/she has performed a successful opening attempt.

In one alternative, the opening attempt sensor is a mechanical switch such as a mechanical lock catch arranged to engage with a protruding part of the drawer. Thereby, a reliable detection of an opening attempt would be achieved, since there is a low risk of an undefined states, i.e. where it is undefined whether the opening attempt sensor is in an open or closed state.

According to still another embodiment, the opening attempt sensor is arranged to detect closing of the drawer subsequent to detecting displacement of the drawer in relation to the chassis, and wherein the control unit is arranged to trigger unlocking of the locking device as a result of the detection of the drawer being closed subsequent to detecting displacement of the drawer in relation to the chassis. Hereby, it is provided a further way to safely unlock the drawer, since the drawer will not be unlocked unless the drawer has been exposed to an opening attempt and then subsequently been closed again, e.g. within a certain time period from the opening attempt or without any other intermediate opening- or locking-related events occurring. Thereby, the risk of the user opening the drawer before the pump has been stopped is further reduced.

According to another embodiment, the locking system is positioned at the rear part of the drawer dishwasher, on the inside of the chassis. The positioning of the locking system at the rear part may provide a safe positioning with regards to wear and fatigue and may also further increase the reliability of the system. Further, the positioning reduces the risk of a user getting injured on e.g. protruding parts in relation to the locking system.

According to yet another embodiment, the locking system further comprises a locking sensor for detecting whether the locking device is locked or unlocked. By the provision of the locking sensor there is provided a way of ensuring that the dishwasher pump will not be turned on while the drawer is unlocked.

According to another aspect of the invention, a method for unlocking a drawer of a drawer dishwasher is provided. The drawer dishwasher has a locking system comprising: a locking device for locking the drawer to a chassis of the dishwasher; an opening attempt sensor for detecting an opening attempt of the drawer; and a control unit connected to the opening attempt sensor and the locking device. The method comprises the steps of: detecting an opening attempt of the drawer; stopping a dishwasher pump of the dishwasher based on the detected opening attempt; and triggering unlocking of the locking device, after the dishwasher pump has been stopped. By the method according to the present solution there is provided a way of opening a drawer of a drawer dishwasher during a washing program without the risk of hot water splashing out onto the user or the floor, since the control unit stops the pump before the drawer is unlocked and hence openable.

BRIEF DESCRIPTION OF THE DRAWINGS

Embodiments of the present solution will now be described, by way of example, with reference to the accompanying schematic drawings in which.

DESCRIPTION OF EMBODIMENTS

The present disclosure will be described in more detail hereinafter with reference to the accompanying drawings, in which one or alternative embodiments of the disclosure are shown. This disclosure may, however, be embodied in many different forms and should not be construed as limited to the embodiments set forth herein; rather, these embodiments are provided so that this disclosure will be thorough and complete, and will fully convey the scope of the invention to those skilled in the art.

Figure 1:
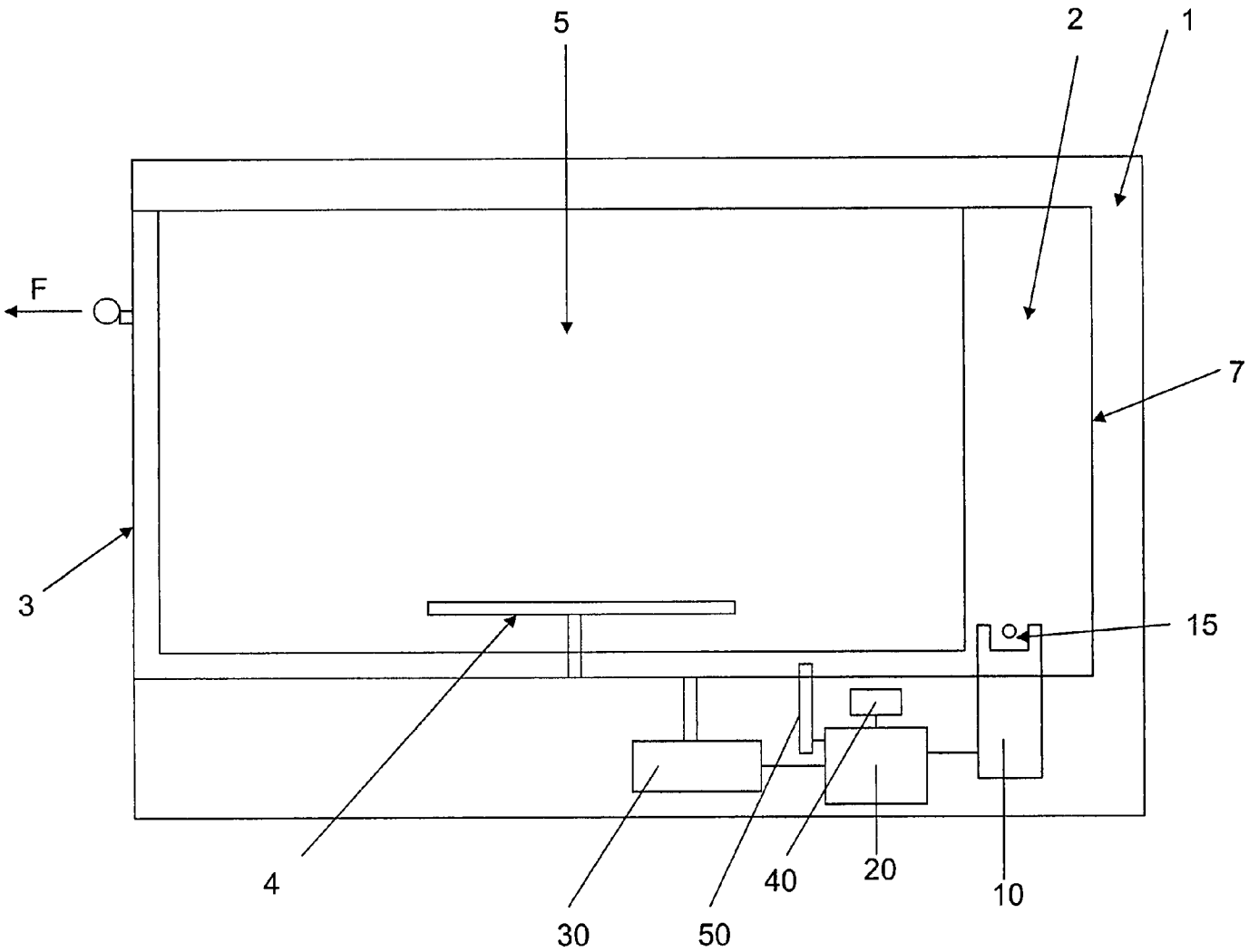
FIG. 1 is a schematic side/sectional view of a drawer dishwasher according to the invention.

FIG. 1 illustrate in a strictly schematic manner the way in which the components of the drawer dishwasher may be arranged according to an embodiment of the invention. Inside a chassis or frame 1 of a drawer dishwasher a drawer 2 is arranged. A front side 3 of the drawer 2, may be covered with e.g. a wooden panel. In the drawer 2 a washing tub 5 is arranged for receiving goods to be dished. In the washing tub 5 a sprinkler 4 is arranged to distribute water inside the washing tub. A dishwasher pump 30 is arranged to provide water to the sprinkler 4 at a water pressure sufficient to clean the goods to be dished. In the figure the dishwasher pump 30 is arranged below the drawer 2, although, the dishwasher pump might as well be placed in any other place in the dishwasher, e.g. in the drawer 2 close to a rear side 7 of the drawer. In one embodiment the dishwasher pump 30 is a circulation pump.

At a rear part of the chassis 1 a locking system according to the invention is arranged, the locking system comprising: an opening attempt sensor 10, a control unit 20 and a locking device 50. According to the embodiment of the invention shown in FIG. 1, the locking system also comprises a locking sensor 40.

The control unit 20 is connected to the opening attempt sensor 10, the locking sensor 40, the locking device 50 and also to the dishwasher pump 30. It shall however be readily appreciated that the parts mentioned above may be arranged in relation to one another in any way suitable for the function of the drawer dishwasher and for the function of the present invention.

The locking device 50 is arranged to lock or unlock the drawer 2 to the chassis 1 of the dishwasher, such that when the locking device is unlocked the drawer can be pulled out from the chassis in an outward direction F perpendicular to a surface of the front side 3 of the dishwasher, and when the locking device is locked the drawer is locked to chassis. In an embodiment, the locking device, when in a locked condition, allows a small movement of the drawer in relation to the chassis, indicating an opening attempt of the drawer.

The opening attempt sensor 10 is arranged to detect that the drawer 2 is exposed to an opening attempt from a user of the dishwasher. According to an embodiment, the opening attempt would be detected as a displacement of the drawer 2 in relation to the chassis 1. For this reason, it is possible to displace the drawer from the chassis by a short distance when the drawer is locked to the chassis by the locking device. By a movement of the drawer in relation to the chassis is meant, according to an embodiment of the invention, a slight horizontal displacement of the drawer from the chassis. The slight horizontal displacement may occur as a result from a pulling force exerted by a user on a handle of the drawer in the outward direction F. Although, the slight horizontal displacement may also be in an inward direction, i.e. in a direction opposite to the outward direction F, as a result of the user pushing the drawer.

The opening attempt sensor 10 would detect the horizontal displacement as the drawer being in an open position and signal to the control unit that the drawer is in an open position. The slight displacement would according to an embodiment typically be about 5-8 mm displacement of the drawer from the chassis. The opening attempt sensor 10 may in one embodiment be a mechanical switch detecting the opening attempt. In the embodiment shown in FIG. 1, the mechanical switch is a mechanical lock catch which engages a protruding part 15 of the drawer 3, such that when the drawer is displaced, the mechanical lock catch will follow the movement of the drawer and detect the opening attempt. However, the opening attempt sensor may be any kind of sensor detecting a displacement of the drawer in relation the chassis, such as an optic sensor or a magnetic sensor, e.g. a Hall sensor.

The control unit 20 is arranged to receive a signal from the opening attempt sensor 10 regarding whether the drawer is exposed to an opening attempt. The control unit 20 is further arranged to trigger stopping of the dishwasher pump 30 when receiving an opening attempt signal from the opening attempt sensor 10. The control unit is further arranged to trigger unlocking of the locking device 50. The control unit 20 is arranged to wait a certain time period after triggering stop of the dishwasher pump and before triggering unlocking of the locking device 50. For detecting lapse of the certain time period, the control unit 20 may be equipped with time measuring means, such as a clock, which may be triggered by a dishwasher pump stop signal.

In an alternative embodiment of the invention, the control unit 20 is arranged to receive a signal from the dishwasher pump 30 indicating that the pump has been stopped, before submitting an unlocking signal to the locking device 50.

The locking sensor 40 is arranged to detect whether the drawer is unlocked or locked.

Figure 2:
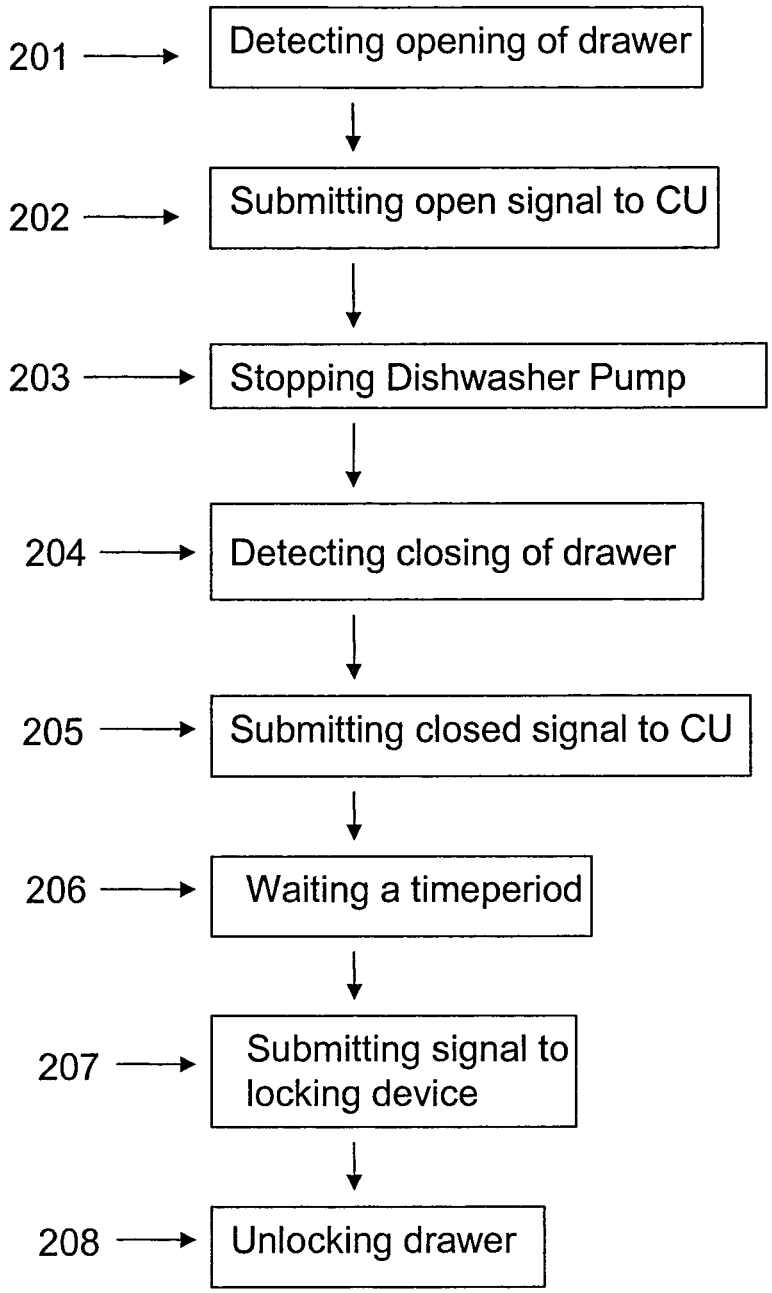
FIG. 2 is a schematic flow chart of a method of the invention.

FIG. 2 schematically represents a flow chart of the interaction between the different parts of the locking system and the drawer dishwasher, according to an embodiment of a method of the invention. The operation will be described below with reference to the reference numerals in FIG. 1.

An attempt to open the drawer 2 results in that the opening attempt sensor 10 detects 201 that the drawer attains a displacement in relation to the chassis, which is detected by the opening attempt sensor 10 as the drawer being in an open position, and in that an open signal is submitted 202 from the opening attempt sensor 10 to the control unit, CU, 20. This open signal triggers the control unit 20 to submit a signal to the dishwasher pump 30 which signal results in that the dishwasher pump is stopped 203. By the stop of the dishwasher pump 30 no water will be distributed via the sprinkler 4 in the washing tub 5.

Subsequently, the drawer is closed, e.g. automatically by a self-closing mechanism or by the user pushing the drawer. The opening attempt sensor 10 then detects 204 that the drawer is in a closed position and submits 205 a closed signal to the control unit 20.

If it is detected that the drawer receives a closed position subsequently after the opening attempt sensor has detected an opening attempt, e.g. within a certain time period from the detected opening attempt or without any other intermediate opening attempt sensor events or locking sensor events occurring, the control unit 20 then waits 206 a time period before submitting 207 a signal to the locking device 50 to unlock the drawer 2 from the chassis 1. The locking device 50 then unlocks 208 the drawer 2, which then can be opened completely by a user. This waiting time period is selected such that the water pumped from the dishwasher pump is not propelled through the nozzle when the locking device is unlocked. Also, the waiting time period should not be too long for a user about to open the drawer of the drawer dishwasher. A suitable waiting time period would be around 1-2 seconds. When the drawer has been opened completely, the opening attempt sensor 10 signals that it is in an open position and the locking sensor 40 signals that the lock is unlocked.

The steps of detecting 204 the closing of the drawer and submitting 205 a closed signal is optional for the operation of the method of the invention.

Figure 3:
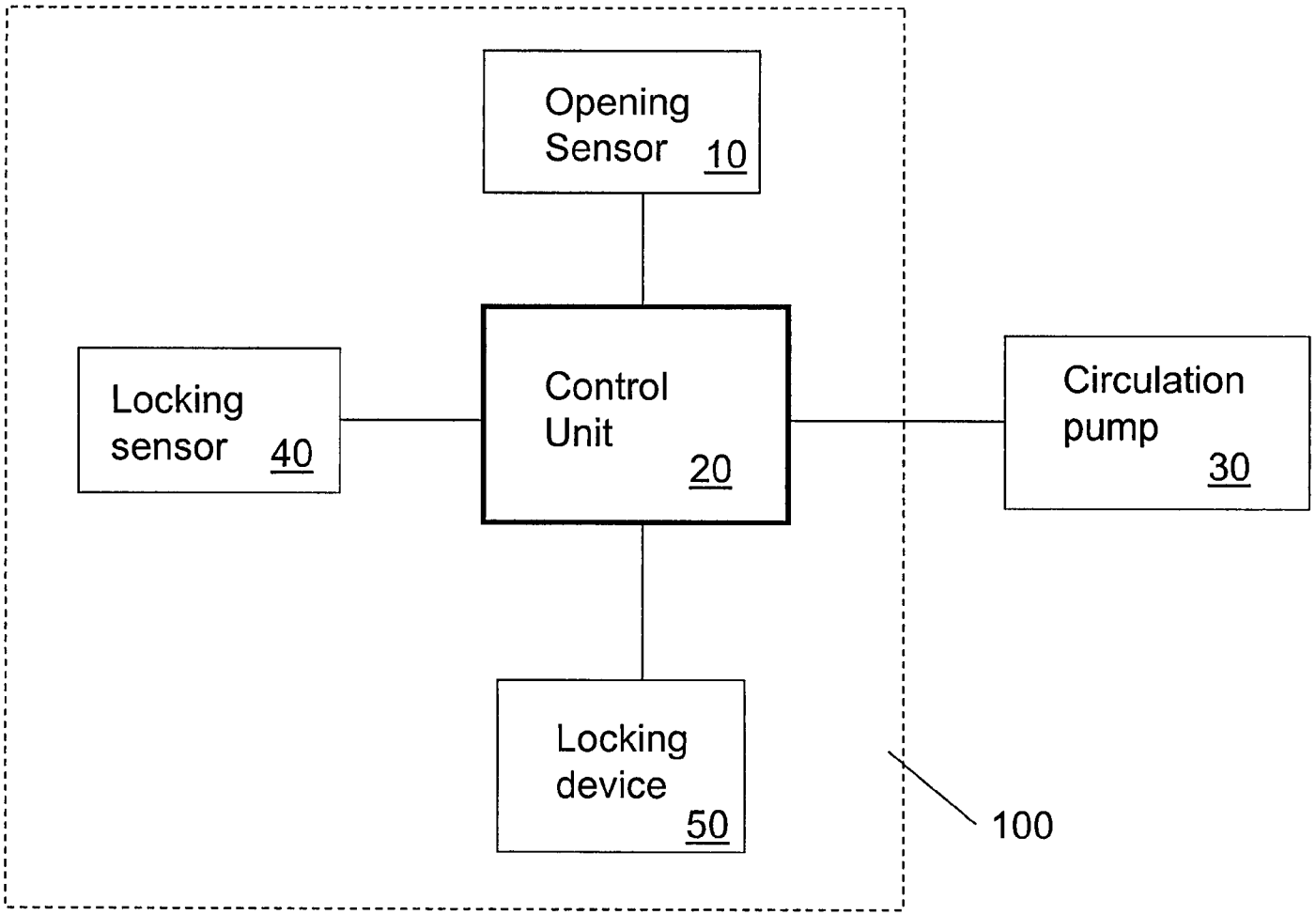
FIG. 3 is a schematic box model of the locking system of the invention.

FIG. 3 describes a schematic box model of the locking system according to the invention and its interaction with a circulation pump 30 of the dishwasher. The locking system 100 comprises an opening attempt sensor 10, a control unit 20, a locking device 50, and an optional locking sensor 40.

Figure 4:
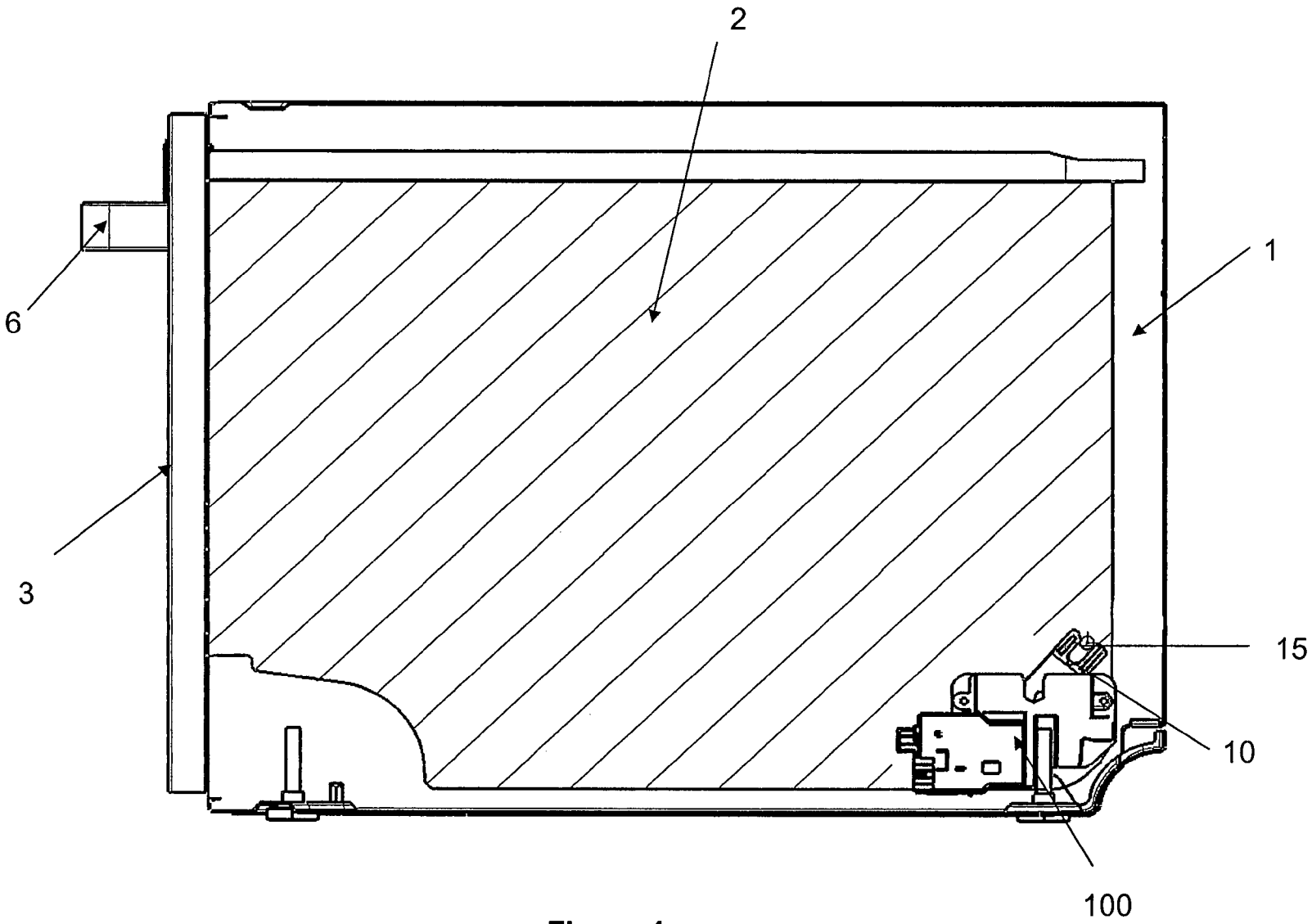
FIG. 4 is a schematic side sectional view of a drawer dishwasher in a fully closed and locked position.

FIG. 4 illustrates a drawer dishwasher according to the invention with the drawer 2 in closed and locked position. The front side 3 of the drawer dishwasher has a handle 6 for opening the drawer dishwasher. In this embodiment, the locking device 50, the locking sensor 40 and the control unit 20 of the locking system is integrated into one physical device which is placed at the rear part of the drawer dishwasher chassis 1. The opening attempt sensor 10 of the locking system is a mechanical lock catch that engages with a protruding part 15 of the drawer 3.

Figure 5:
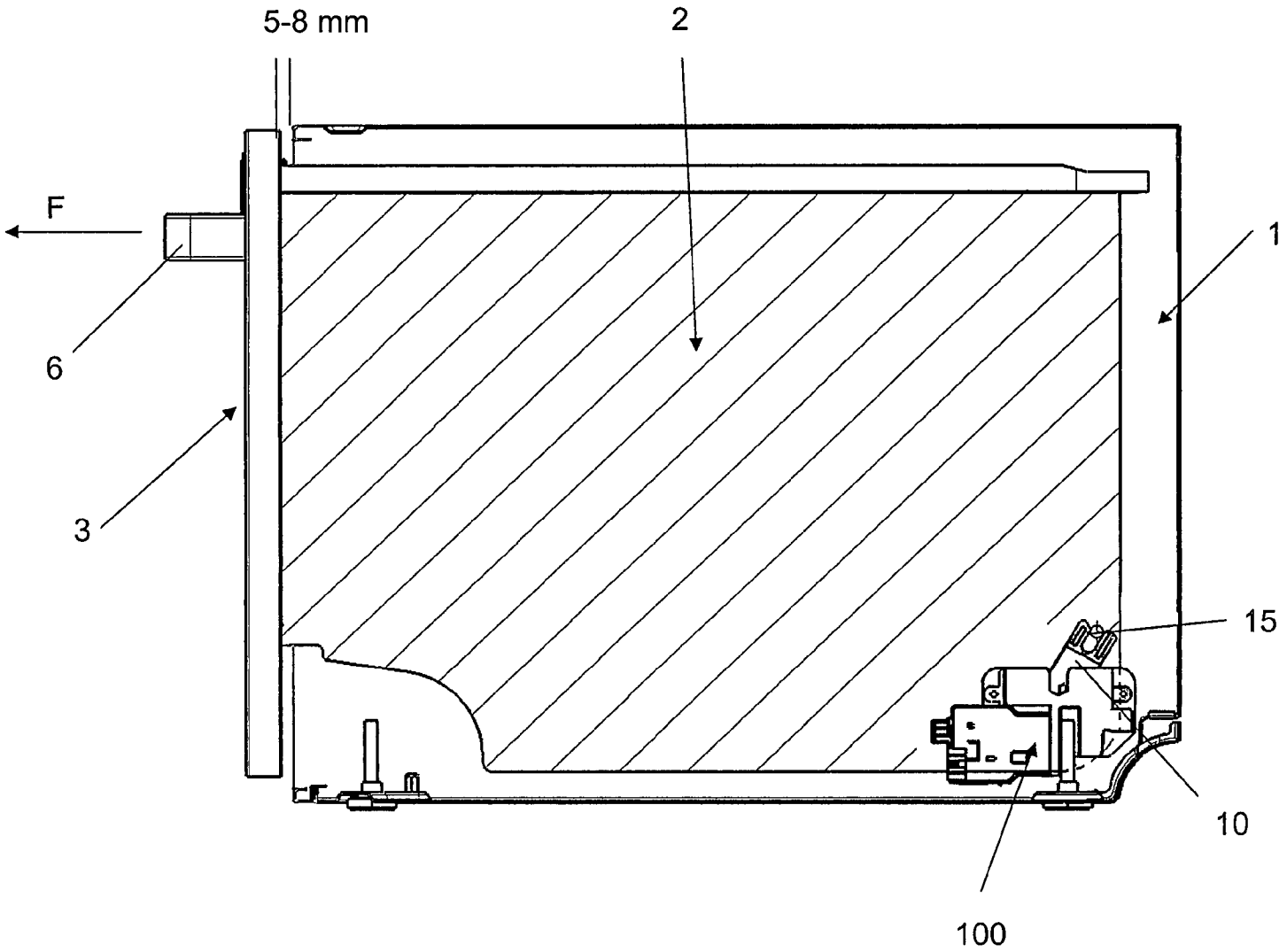
FIG. 5 is a schematic side sectional view of a drawer dishwasher exposed to an opening attempt.

FIG. 5 illustrates the drawer dishwasher of FIG. 4 at an opening attempt of the drawer 2. A slight outward movement, e.g. by pulling the handle 6 arranged at the front side 3 of the dishwasher in the direction of the arrow F in the figure, shown as "5-8 mm" in the figure, is detected by the opening attempt sensor 10 when the mechanical lock catch moves due to the movement of the drawer and consequently of the protruding part of the drawer.

Figure 6:
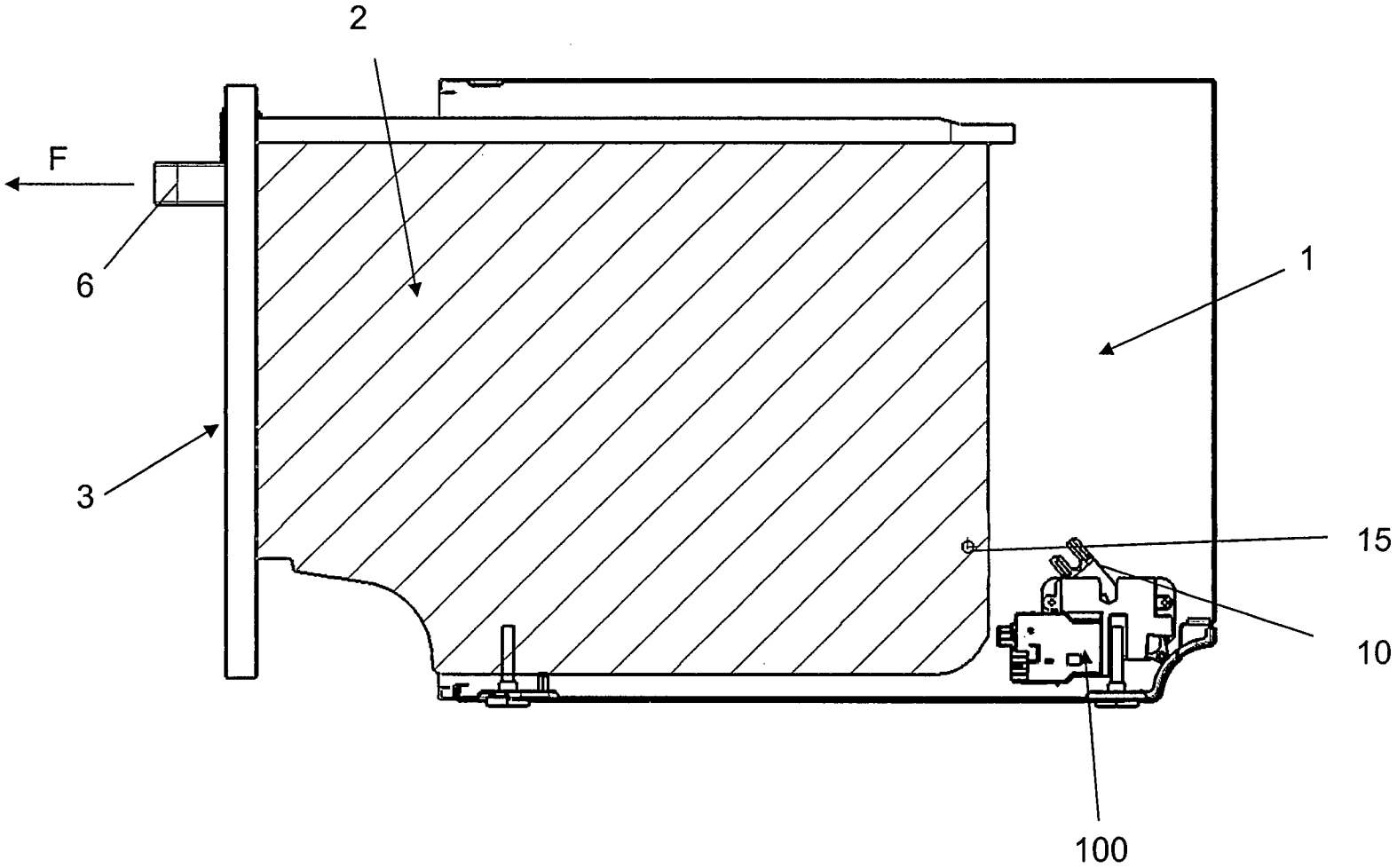
FIG. 6 is a schematic side sectional view of a drawer dishwasher in an open position.

FIG. 6 illustrates the drawer dishwasher of FIG. 4, where the drawer 2 has been pulled out in the direction of the arrow F. For achieving this open position of the drawer, the locking device 50 has unlocked such that it has been made possible for the mechanical lock catch of the opening attempt sensor 10 to move in such a way that the lock catch has released its grip of the protruding part 15 of the drawer 3.

In an alternative embodiment of the invention, the opening attempt sensor 10 may be arranged to detect that the drawer is exposed to an opening attempt without the drawer being allowed to be displaced from the chassis when the locking device is locked. In this case, the opening attempt sensor 10 may be arranged to detect a force exposed to the drawer, a force intended to open the drawer, originating from e.g. a user pushing the drawer or pulling a handle attached to the drawer.

According to an embodiment of the invention, when the control unit triggers stop of the dishwasher pump during a washing process, the control unit is also arranged to set the washing process in a stand-by mode such that the washing process can be restarted at the same moment where the washing process was stopped.

In one embodiment the control unit 20 is a programmable software control unit.

In one embodiment of the present solution, the locking device 50 is an electro mechanical locking unit. In another embodiment, when the locking device unlocks the drawer, a conductor supplying the dishwasher pump with electrical power is mechanically disconnected from the pump to further ensure that the dishwasher pump is shut off, and also that the pump cannot be started by mistake when the locking device is unlocked.

In an alternative embodiment the locking sensor 40 is a photo transistor device detecting proper locking of the drawer by light reflection.

In an embodiment of the invention, the dishwasher includes a drawer-closing mechanism for automatically closing the drawer from an opening attempt position, when the drawer has been displaced in relation to the chassis with a small distance, e.g. 5-8 mm, into a closed position when a front side of the drawer is in direct contact with the chassis.

In an alternative embodiment of the dishwasher, the drawer 2 can be opened during a washing phase by exerting a high pulling force on the drawer 2, e.g. a force of at least 250 N. The purpose of such an opening possibility is to be able to open the drawer when the drawer cannot be opened in the regular way described above, or when the drawer for some reason has to be opened very quickly.

According to embodiments of the present solution the drawer may also, conversely, be locked and restarted again when the drawer dishwasher has been opened and unlocked and the dishwasher pump 30 has been stopped during a washing program. In that case, the drawer has to be closed and locked to the chassis before the drawer can be restarted.

In one embodiment, the procedure for restarting the dishwasher has the following course of events: A user closes the drawer. The opening attempt sensor 10 detects the closing of the drawer 2 and submits a signal to the control unit 20 that the drawer is in a closed position. The control unit waits for a period of time before submitting a locking signal to the locking device. The period of time should be enough to ensure that the closing of the drawer 2 was intentional. In one embodiment the period of time is about 6 seconds. The locking device 50 locks the drawer, after receiving the locking signal. Then the locking sensor 40 detects that the drawer is locked and submits a locked signal to the control unit 20. When the control unit 20 has received a signal from the opening attempt sensor 10 that the drawer is closed and a signal from the locking sensor 40 that the drawer is locked, the control unit 20 submits a signal to the dishwasher pump 30, which resumes distributing water through the sprinkler 4 in the washing tub 5.

Such a solution could also be used for avoiding stop of the washing program due to an unintentional opening attempt. In that case, somebody by mistake performs an opening attempt and the opening attempt sensor detects the opening attempt, which results in stopping of the dishwasher pump and unlocking of the locking device. However, no complete opening of the drawer is performed. In case the drawer has not been opened completely for a period of time, which may be around 6 seconds, the control unit can be arranged to lock the locking device again and resume the washing program.

The invention claimed is:

1. A locking drawer system for a drawer dishwasher, said system comprising:

a locking device for selectively locking and unlocking the drawer to a chassis of the dishwasher, wherein said drawer is capable of a slight displacement while in a locked condition;

an opening attempt sensor for detecting an attempt to open the drawer, said opening attempt sensor being arranged to detect a displacement of the drawer in relation to the chassis of the dishwasher while in the locked condition, and to detect a closing of the drawer subsequent to detecting the displacement of the drawer in relation to the chassis in the locked condition; and a control unit connected to the opening attempt sensor and the locking device;

wherein the control unit is arranged to trigger a stop of a dishwasher pump of the dishwasher based on a detected opening attempt, and wherein the control unit is further arranged to trigger the locking device to unlock after the dishwasher pump has been stopped, upon the detection of the drawer being closed subsequent to the detection of displacement of the drawer from the chassis while in the locked condition.

2. A locking drawer system for a drawer dishwasher according to claim 1, wherein the control unit is arranged to wait for a period of time after triggering stop of the dishwasher pump and before triggering unlocking of the locking device.

3. A locking drawer system for a drawer dishwasher according to claim 2, wherein the period of time is 1-2 seconds.

4. A locking drawer system for a drawer dishwasher according to claim 1, wherein the control unit is arranged to wait for a signal indicating that the dishwasher pump has been stopped before triggering the unlocking of the locking device.

5. A locking drawer system for a drawer dishwasher according to claim 1, wherein the opening attempt sensor is a mechanical switch.

6. A locking drawer system for a drawer dishwasher according to claim 5, wherein the mechanical switch is a mechanical lock catch arranged to engage with a protruding part of the drawer.

7. A locking drawer system for a drawer dishwasher according to claim 1, wherein the dishwasher has a front part close to a front side of the dishwasher and a rear part distal to the front side; and wherein the locking system is positioned at the rear part of the inside of the drawer dishwasher chassis.

8. A locking drawer system for a drawer dishwasher according to claim 1, wherein the locking system further comprises a locking sensor for detecting whether the locking device is locked or unlocked.

9. A locking drawer system according to claim 1, wherein the locking device is capable of being actuated to effect said unlocking by drawer movement.

10. A locking drawer system according to claim 1, wherein the drawer is freely movable to an open position immediately upon unlocking of the locking device.

11. A locking drawer system according to claim 1, wherein the closing of the drawer subsequent to the detected displacement of the drawer is performed by a self-closing mechanism.

12. A method for unlocking a drawer of a drawer dishwasher, said drawer dishwasher having a locking drawer system comprising: a locking device for locking the drawer to a chassis of the dishwasher, wherein said drawer is capable of a slight displacement while in a locked condition; an opening attempt sensor for detecting an attempt to open the drawer; and a control unit connected to the opening attempt sensor and the locking device, the method comprising the steps of:

detecting an attempt to open the drawer with said sensor, said detecting comprising detecting a displacement of the drawer in relation to the chassis of the dishwasher while in the locked condition, and detecting a closing of the drawer subsequent to detecting the displacement of the drawer in relation to the chassis in the locked condition;

stopping a dishwasher pump of the dishwasher based on the detected opening attempt detected with said sensor; and triggering unlocking of the locking device, after the dishwasher pump has been stopped, upon the detection of the drawer being closed subsequent to the detection of displacement of the drawer in relation to the chassis while in the locked condition.

13. A method according to claim 12, wherein the control unit waits for a period of time after the dishwasher pump has been stopped and before triggering the unlocking of the locking device.

14. A method according to claim 12, wherein the control unit waits for a signal that the dishwasher pump has been stopped before triggering the unlocking of the locking device.

15. A method according to claim 12, further comprising the step of maintaining the locking device's locked condition throughout the detected opening attempt.

16. A method according to claim 12, wherein the drawer becomes freely movable to an open position immediately upon unlocking of the locking device.

* * * * *